US005087290A

United States Patent [19]

Wolfsgruber et al.

[11] Patent Number: 5,087,290

[45] Date of Patent: Feb. 11, 1992

[54] AGENT FOR THE TREATMENT OF CAST IRON MELTS, PROCESS FOR THE PRODUCTION THEREOF AND THE USE THEREOF FOR TREATING CAST IRON MELTS

[75] Inventors: Friedrich Wolfsgruber, Tacherting; Wolfgang Geiger, Trostberg; Detlef Missol, Engelsberg, all of Fed. Rep. of Germany

[73] Assignee: SKW Trostberg Aktiengesellschaft, Trostberg, Fed. Rep. of Germany

[21] Appl. No.: 555,572

[22] Filed: Jul. 19, 1990

[30] Foreign Application Priority Data

Jul. 25, 1989 [DE] Fed. Rep. of Germany ..... 3924558

[51] Int. Cl.[5] ..... C22C 33/08

[52] U.S. Cl. ..... 75/303; 420/25; 420/27

[58] Field of Search ..... 420/19-27; 75/303

[56] References Cited

U.S. PATENT DOCUMENTS

| | | | |
|---|---|---|---|
| 2,485,761 | 10/1949 | Millis | 420/27 |
| 3,177,071 | 4/1965 | Ebert | 420/25 |
| 4,036,641 | 7/1977 | Evans | 420/25 |
| 4,086,086 | 4/1978 | Dawson | 420/25 |

*Primary Examiner*—Peter D. Rosenberg

[57] ABSTRACT

The present invention provides an agent for the desulphurization, magnesium treatment and inoculation of cast iron melts in a single step based on a silicon alloy, wherein the agent has the following composition:

| | |
|---|---|
| silicon | 30 to 80% by wt. |
| magnesium | 5 to 30% by wt. |
| calcium | 0.1 to 25% by wt. |
| bismuth | 0.1 to 2% by wt. |
| cerium mischmetal | 0.1 to 5% by wt. |
| iron | balance. |

The present invention also provides processes for the production of this agent. In addition, the present invention is concerned with the use of this agent for the simultaneous desulphurization, magnesium treatment and inoculation of cast iron melts in a single step.

22 Claims, No Drawings

AGENT FOR THE TREATMENT OF CAST IRON MELTS, PROCESS FOR THE PRODUCTION THEREOF AND THE USE THEREOF FOR TREATING CAST IRON MELTS

The present invention is concerned with an agent for treating molten cast iron based on a silicon alloy for the production of cast iron with spheroidal graphite, a process for the production of this agent, as well as the use thereof.

As is known, cast iron melts contain considerable amounts of carbon dissolved therein which, in the case of solidification of the melt, normally solidifies in lamellar form. The castings produced from such melts only show insufficient mechanical strength properties.

By adding magnesium and rare earth metals to the melt it is possible to modify the solidification of the carbon thus that a spheroidal formation is achieved. Castings produced from iron melts treated in this manner significantly exceed, the mechanical strength of cast iron with lamellar graphite.

In principle, it is possible to introduce metallic magnesium into the molten iron to produce spheroidal graphite cast iron but, because of the violent reaction of the magnesium, special, technically laborious measures are necessary. Even in the case of the use of ferrosilicon-magnesium, it can result in violent, non-uniform reactions, resulting in a poor reproducability of the process. Nevertheless, ferrosilicon-magnesium alloys are the most frequently used alloys for promoting spheroidal graphite formation in cast iron. Additives of cerium, rare earth metals and calcium are used to control the reactivity of these alloys (see Foundry Trade J. Int., 33, 38/1987, middle column, paragraph 1).

Furthermore, it is known that for the complete effectiveness of such spheroid- or spherolite-forming additives, the cast iron melts: must be desulphurised. This is also confirmed by a remark in Foundry J. Int., 33/1987 on page 38, lefthand column, paragraph 2, according to which a low sulphur content is a prerequisite for "clean iron" to be poured.

Because of the high affinity to sulphur, any addition of magnesium to sulphur-containing cast iron melts exerts a desulphurising reaction. The higher the sulphur content of the cast iron melt is, the more magnesium is needed for the desulphurisation reaction. Therefore, in order to minimize the magnesium addition, it is recommended to aim for a base iron with a low sulphur content which, however, is not always possible in practice. Therefore, in many cases, it is necessary to carry out a predesulphurisation according to known desulphurisation processes, for example by the introduction of calcium carbide.

Cast iron alloys solidify grey, white or mottled. All these structures can occur together within one casting. The reason for this behavior is the amount of nucleus which are in relation to the cooling rates within the casting, whereby the equilibrium temperature of the eutectic grey solidification is gone below. In order to ensure the desired grey solidification, the melt is inoculated. Inoculation means the addition of nucleus or nucleus generating agents to the melt to modify the solidification behavior of the cast iron. The inoculation can take place in the launder or in the ladle, into the stream or in the mould in one or more steps.

As a rule, the desulphurisation, the magnesium treatment and the inoculation are carried out separately, which is again confirmed by Foundry Trade J. Int., 33/1987, page 39, lefthand column, paragraph 2: More effective inoculation agents contain, inter alia, calcium and bismuth, which are added after the magnesium treatment, when the formation of the spherolitic graphite has taken place. The exceptions are the converter process and the plunging treatment with pure magnesium or high percentage ferrosilicon-magnesium alloys.

It is an object of the present invention to provide a treatment agent for cast iron melts with which all of the previously necessary treatments can be carried out in a single step.

This object is achieved by an agent based on a silicon alloy containing magnesium, calcium, bismuth and rare earth metals, the remainder being iron.

An alloy is preferred which has the following composition:

| | |
|---|---|
| silicon | 30 to 80% by wt. |
| magnesium | 5 to 30% by wt. |
| calcium | 0.1 to 25% by wt. |
| bismuth | 0.1 to 2% by wt. |
| cerium mischmetal | 0.1 to 5% by wt. |
| iron | balance. |

Bismuth in combination with cerium mischmetal in the agent according to the present invention has a high nucleus effectiveness. This is especially surprising because bismuth, besides, for example, titanium, aluminium and lead, belongs to the elements which inhibit the spheroidal graphite formation in iron-carbon alloys. Because of the production process of the agent via a calcium-silicon of ferrosilicon alloying, it is, in addition, possible that, due to the raw materials used, the agent also contains small amounts of aluminium.

An agent has proved to be especially suitable for simultaneous desulphurisation, inoculation and magnesium treatment and has the following composition:

| | |
|---|---|
| silicon | 40 to 60% by wt. |
| magnesium | 15 to 25% by wt. |
| calcium | 5 to 20% by wt. |
| bismuth | 0.3 to 1% by wt. |
| cerium mischmetal | 0.3 to 3% by wt. |
| iron | balance |

Depending upon the initial sulphur content of the iron melt and its temperature, the ratio of calcium, magnesium and silicon can be adjusted to meet the desulphurisation requirements or to control the reactivity of the alloy. Thus an agent with optimum composition for each appliance can be made available.

The production of the agent according to the present invention can, according to a first preferred embodiment, be carried out by first producing a calcium-silicon or ferrosilicon melt in an electric submerged arc furnace. In the case of calcium-silicon, the calcium content preferably amounts to about 28 to 33% by weight and the silicon content to about 60% by weight during tapping. In the case of ferrosilicon, the melt is to contain about 60 to 75% by weight of silicon.

After tapping the calcium-silicon melt with a temperature of about 1800° to 2000° C. and with a content of calcium of about 28 to 33% by weight, the melt is alloyed in the ladle by stirring in the required amount of magnesium as well as bismuth and the cerium mischmetal, preferably in metallic form.

In the case of ferrosilicon, the melt with a temperature of about 1250° to 1450° C. is tapped off into a ladle, alloyed with magnesium, preferably in form of pure metal and adjusted to the desired calcium content of the alloy by adding metallic calcium or calcium-silicon and finally bismuth and the rare earth metal (cerium mischmetal) by stirring these alloying additions in. Alternatively, the calcium content can be controlled directly in the base melt tapped from the submerged arc furnace by appropriate composition of the furnace charge raw materials. In a similar way rare earth minerals can be added in form of bastnaesite, monazite or in form of rare earth oxides &o the furnace charge. Preferably, however, the rare earth metal is added to the base alloy in form of cerium mischmetal since this allows a more precise control of the alloy composition.

According to a further preferred embodiment, the production of the agent according to the present invention takes place in an induction furnace from metallic components. In this case, the production process is in principle analogous to that for the production of the agent according to the invention. The required temperature range of the base melt is 1000°to 1250° C. Under these conditions, the required elements can be introduced into the melt and after a short time the final agent can be poured off.

After solidification, the agent can be used for the treatment of cast iron melts in the form of lumps or pieces as over pour alloy or as plunging alloy. However, the agent is preferably added into the pouring stream of molten metal with a suitable device in the form of a fine granulate or, especially preferably, by enveloping with sheet metal cover it is introduced in the form of a filled wire. The use of a filled wire is especially preferred because not only the injection of the agent into the cast iron melt, but also the precise control of the addition rate is readily achievable.

Depending upon the composition of the cast iron melt, the agent according to the present invention is used in an amount of from 0.35 to 1.5% by weight, referred to the weight of the cast iron. The injection rate of filled wires of 5 to 20 mm. diameter can be varied between 1 and 150 m./min. and preferably, in the case of appropriately chosen wire diameter addition rates of 10 to 50 m./min. can be used.

With the help of the agent according to the present invention, it is possible, in an optimum manner, to simplify the treatment of cast iron melts since only one treatment procedure is necessary. The treatment can be carried out in a ladle in a short periode of time with small temperature losses. Due to the combination of silicon-magnesium-calcium with bismuth and rare earth metals, sufficient desoxidation and desulphurisation of the cast iron melts is achieved and simultaneously a high concentration of nucleus-forming elements is provided. This results in a complete spherolytic graphite solidification. The castings show completely homogeneous properties, even with varying section thickness.

Finally, it can prove to be preferable, although the inoculation action of the combination of bismuth/rare earth metal reduce fading, to follow the above described combined treatment process with a further inoculation commerically available inoculant, especially an inoculation grade ferrosilicon. Because of the treatment with the alloy according to the present invention, a secondary addition of inoculation agents requires only small addition rates.

The following Examples are given for the purpose of illustrating the present invention:

EXAMPLE 1

350 kg. of magnesium and subsequently 7 kg. of cerium mischmetal are stirred at 1500° to 1600° C. into 770 kg. of molten calcium-silicon with a content of calcium of 30% by weight. Finally 6 kg. of bismuth are added thereto in the form of granules. The alloy obtained has the following composition:

| | |
|---|---|
| silicon | 40.4% by wt. |
| magnesium | 23.5% by wt. |
| calcium | 19.8% by wt. |
| bismuth | 0.5% by wt. |
| cerium mischmetal | 0.49% by wt. |
| iron | 15.1% by wt. |

The alloy is crushed and screened to a grain size of 0.2 by 1.6 mm., appropriate for a filed wire, and packed into a filled wire with a diameter of 13 mm. The wire so produced has the following characteristics:

| | |
|---|---|
| wire tpy | 13 mm. |
| wire weight | 350 g./m. |
| weight of filling material | 200 g./m. |
| filling factor | 57% |
| calcium content | 40 g./m. |
| magnesium content | 47 g./m. |
| silicon content | 80 g./m. |
| bismuth content | 1 g./m. |
| cerium mischmetal content | 1 g./m. |

Iron melted in a cold blast cupola furnace and having the following chemical composition

| | |
|---|---|
| carbon | 3.68% by wt. |
| silicon | 2.04% by wt. |
| manganese | 0.14% by wt. |
| phosphorus | 0.048% by wt. |
| sulphur | 0.075% by wt. |

is treated with filled wire with the above-given characteristics. The wire is being introduced into the cast iron melt with a wire feeding device. The amount of iron treated varies between 630 and 650 kg. The treatment vessel used is a typical covered ductile iron treatment ladle, with a height to diameter ratio of 2.4:1. The experimental results obtained with five treatments are summarised in the following Table 1.

TABLE 1

| treatment | 1 | 2 | 3 | 4 | 5 |
|---|---|---|---|---|---|
| amount treated (kg.) | 650 | 630 | 630 | 635 | 630 |
| wire added (m.) | 30 | 30 | 32 | 32 | 30 |
| wire feed rate (m./min.) | 30 | 30 | 30 | 28 | 30 |
| temperature before treatment (°C.) | 1475 | 1473 | 1470 | 1460 | 1465 |
| temperature after treatment (°C.) | 1450 | 1455 | 1445 | 1450 | 1442 |

TABLE 1-continued

| treatment | 1 | 2 | 3 | 4 | 5 |
|---|---|---|---|---|---|
| % sulphur, before | 0.073 | 0.073 | 0.073 | 0.073 | 0.073 |
| % sulphur, treated | 0.008 | 0.007 | 0.006 | 0.006 | 0.007 |
| % sulphur difference | 0.065 | 0.066 | 0.067 | 0.067 | 0.066 |
| % magnesium used | 0.217 | 0.224 | 0.239 | 0.237 | 0.224 |
| % residual magnesium | 0.043 | 0.045 | 0.052 | 0.051 | 0.049 |
| % magnesium recovery | 42.6 | 42.5 | 43.1 | 43.0 | 44.3 |
| proportion of spheroidal graphite | >90% | >90% | >90% | >90% | >90% |
| spherolite number/mm$^2$ (Y-2 sample) | 100–200 | 100–200 | 100–200 | 100–200 | 100–200 |

The reduction of the sulphur content from 0.073% to <0.01% is achieved in each of the 5 treatments. More than 90% of the graphite formation in the Y-2 test bar (25 mm.) has a spheroidal form. The spherolite number with 100 to 200 spheroids/mm$^2$ proves the preinoculation efficiency of the treatment alloy.

EXAMPLE 2.

350 kg. of magnesium, 7 kg. of cerium mischmetal and 6 kg. of bismuth are stirred at 1400°to 1500° C. into 760 kg. of a ferrosilicon melt: containing 75% by weight of silicon, the calcium content of which had already been adjusted to 7.6% by weight by the addition of lime to the furnace charge. The alloy has the following composition:

| | |
|---|---|
| silicon | 50.2% by wt. |
| magnesium | 24.3% by wt. |
| calcium | 5.1% by wt |
| bismuth | 0.5% by wt. |
| cerium mischmetal | 0.48% by wt. |
| iron | balance |

The crushing and sizing procedure of the alloy is the same manner as described in Example 1. Filled wire produced therewith has the following characteristics:

| | |
|---|---|
| wire tpy | 13 mm. |
| wire weight | 348 g./m. |
| weight of filling material | 198 g./m. |
| filling factor | 57% |
| calcium content | 10 g./m. |
| magnesium content | 40 g./m. |
| silicon content | 99 g./m. |
| bismuth content | 1 g./m. |
| cerium mischmetal content | 1 g./m. |

1000 kg. of base iron, melted in an electric arc furnace, with the following chemical composition:

| | |
|---|---|
| carbon | 3.78% by wt. |
| silicon | 1.75% by wt. |
| manganese | 0.50% by wt. |
| sulphur | 0.019% by wt. |

was treated by feeding in 24 m. of the wire. The results as summarised in Table 2 were obtained:

TABLE 2

| treatment | 1 | 2 |
|---|---|---|
| amount treated (kg.) | 1000 | 1000 |
| wire added (m.) | 24 | 24 |
| wire feed rate (m./min.) | 25 | 25 |
| temperature before treatment (°C.) | 1452 | 1448 |
| temperature after treatment (°C.) | 1428 | 1423 |
| % sulphur, before | 0.019 | 0.019 |
| % sulphur, treated | 0.009 | 0.010 |

TABLE 2-continued

| treatment | 1 | 2 |
|---|---|---|
| % sulphur difference | 0.010 | 0.009 |
| % magnesium used | 0.1152 | 0.1152 |
| % residual magnesium | 0.035 | 0.033 |
| % magnesium recovery | 37.0 | 37.0 |
| proportion of spheroidal graphite | >90% | >90% |
| spherolite number/mm$^2$ (Y-3 sample) | 100 | 100 |

Because of the low sulphur content of the base iron, it was possible to choose a treatment agent with only 10 g. calcium/m. of wire. Furthermore, the base alloy was adjusted for the production of a thick-section casting. The proportion of spheroidal graphite and the spherolite number in the cast Y-3 test bar (50 mm.) were as expected.

We claim:

1. Agent for the desulphurisation, magnesium treatment and inoculation of cast iron melts to produce, in a single step, cast iron with spheroidal graphite, wherein the agent has the following composition:

| | |
|---|---|
| silicon | 30 to 80% by wt. |
| magnesium | 5 to 30% by wt. |
| calcium | 0.1 to 25% by wt. |
| bismuth | 0.1 to 2% by wt. |
| cerium mischmetal | 0.1 to 5% by wt. |
| iron | balance. |

2. Agent according to claim 1, wherein it has the following composition:

| | |
|---|---|
| silicon | 40 to 60% by wt. |
| magnesium | 15 to 25% by wt. |
| calcium | 5 to 20% by wt. |
| bismuth | 0.3 to 1% by wt. |
| cerium mischmetal | 0.3 to 3% by wt. |
| iron | balance |

3. Process for the production of an agent according to claim 1, wherein to a ferrosilicon or calcium-silicon melt are added the other components in metallic form.

4. Process according to claim 2, wherein the other components are added to the ferrosilicon or calcium-silicon melt after tapping-off into the ladle.

5. Process according to claim 4, wherein a calcium-silicon base alloy is tapped into a ladle and magnesium, bismuth and cerium mischmetal are alloyed therewith by stirring.

6. Process according to claim 4, wherein a ferrosilicon base alloy is adjusted in its calcium content by appropriate furnace charge composition and after tapping into a ladle, magnesium, bismuth and cerium mischmetal are alloyed there by stirring.

7. Process for the production of an agent according to claim 1, wherein it is produced in an induction furnace by alloying together the metallic components.

8. Process for the production of an agent according to claim 1, substantially as hereinbefore described and exemplified.

9. The use of an agent according to claim 1 in the form of a filled wire, consisting of a sheet metal covering and a finely-divided filling material for the simultaneous desulphurisation, magnesium treatment and inoculation of cast iron melts in a single step.

10. The use according to claim 9, wherein the agent is used in an amount of from 0.35 to 1.5% by weight, referred to the weight of the cast iron.

11. The use according to claim 9 wherein the wire is introduced into the cast iron melt at a speed of 1 to 150 m./min.

12. The use according to claim 11, wherein the wire is introduced into the cast iron melt at a speed of 10 to 50 m./min.

13. The use according to claim 1 wherein, after treatment of the cast iron melt with an agent according to claim 1, there is carried out a post inoculation with a conventional inoculation agent.

14. Cast iron, whenever treated in the melt with an agent according to claim 1.

15. An agent according to claim 1, produced by a process according to claim 4.

16. An agent according to claim 1, produced by a process according to claim 5.

17. An agent according to claim 1, produced by a process according to claim 6.

18. An agent according to claim 1, produced by a process according to claim 7.

19. An agent according to claim 1, produced by a process according to claim 8.

20. An agent according to claim 1, produced by a process according to claim 9.

21. The use according to claim 12, wherein the wire is introduced into the cast iron melt at a speed of 1 to 150 m./min.

22. The use according to claim 21, wherein the wire is introduced into the cast iron melt at a speed of 10 to 50 m./min.

* * * * *